US005863306A

United States Patent [19]

Wei et al.

[11] Patent Number: 5,863,306

[45] Date of Patent: Jan. 26, 1999

[54] PRODUCTION OF PATTERNED ABRASIVE SURFACES

[75] Inventors: Paul Wei, Amherst; Gwo Shin Swei, East. Amherst; Wenliang Patrick Yang, Ballston Lake; Kevin Bruce Allen, Latham, all of N.Y.

[73] Assignee: Norton Company, Worcester, Mass.

[21] Appl. No.: 892,494

[22] Filed: Jul. 14, 1997

Related U.S. Application Data

[63] Continuation of Ser. No. 782,013, Jan. 7, 1997, abandoned.

[51] Int. Cl.[6] ..... B24D 3/34

[52] U.S. Cl. ..... 51/295; 51/298; 51/307; 51/309

[58] Field of Search ..... 51/293, 295, 309, 51/307

[56] References Cited

U.S. PATENT DOCUMENTS

| | | | |
|---|---|---|---|
| 2,252,683 | 8/1941 | Albertson | 51/298 |
| 2,292,261 | 8/1942 | Albertson | 51/298 |
| 5,014,468 | 5/1991 | Ravipati et al. | 51/295 |
| 5,152,917 | 10/1992 | Pieper et al. | 51/309 |
| 5,304,223 | 4/1994 | Peiper et al. | 51/293 |

FOREIGN PATENT DOCUMENTS

| | | |
|---|---|---|
| 2-83172 | 3/1990 | Japan . |
| 4-159084 | 6/1992 | Japan . |

*Primary Examiner*—Deborah Jones
*Attorney, Agent, or Firm*—David Bennett

[57] ABSTRACT

Coated abrasives suitable for very fine abrading applications can be obtained by depositing a layer of a formulation comprising abrasive grits, fillers, grinding aid, additives and a binder resin on a substrate, treating the formulation to increase the viscosity and render it plastic but non-flowing, embossing a suitable pattern on the surface of the layer, and then curing the binder component of the formulation.

17 Claims, 3 Drawing Sheets

PRODUCTION OF PATTERNED ABRASIVE SURFACES

This application is a continuation of application Ser. No. 08/782,013 filed on Jan. 7, 1997 and now abandoned.

BACKGROUND OF THE INVENTION

This invention relates to the production of patterned abrasive surfaces on substrates in a form useful for fine finishing of substrates such as metals, wood, plastics and glass.

The proposal to deposit isolated structures such as islands of a mixture of a binder and abrasive material on a backing material has been known for many years. If the islands have very similar heights above the backing and are adequately separated then, (perhaps after a minor dressing operation), use of the product will result in reduced surface scratching and improved surface smoothness. In addition the spaces between the islands provide a route by which swarf generated by the abrasion can be dispersed from the work area.

In a conventional coated abrasive, investigation of the grinding surface reveals that a comparatively small number of the surface abrasive grits in an active abrading zone are in contact with the workpiece at the same time. As the surface wears, this number increases but equally the utility of some of those abrasive grits may be reduced by dulling. The use of abrasive surfaces comprising a uniform array of isolated islands has the advantage that the uniform islands wear at essentially the same rate such that a uniform rate of abrasion can be maintained for longer periods. In a sense the abrading work is more evenly shared among a larger number of grinding points. Moreover since the islands comprise many smaller particles of abrasive, erosion of an island uncovers new, unused abrasive particles which are as yet undulled.

One technique for forming such an array of isolated islands or dots that has been described is that of the rotogravure printing. The technique of rotogravure printing employs a roll into the surface of which a pattern of cells has been engraved. The cells are filled with the formulation and the roll is pressed against a surface and the formulation in the cells is transferred to the surface. Normally the formulation would then flow until there was no separation between the formulations deposited from any individual cell. Ultimately a layer of essentially uniform thickness would be obtained. By way of illustration, comparative Examples C and D of U.S. Pat. No. 5,152,917 describe a process in which the pattern obtained by a rotogravure process quickly lost all separation of the individual amounts deposited from the cells.

In U.S. Pat. No. 5,014,468 a binder/abrasive formulation was deposited from rotogravure cells on a roller in such a way that the formulation was laid down in a series of structures surrounding an area devoid of abrasive. This is believed to be the result of depositing less than the full volume of the cell and only from the perimeter of each cell, which would leave the ring formations described.

The problem with the rotogravure approach has therefore always been the retention of a useful shape to the island. To formulate an abrasive/binder mixture that is sufficiently flowable to be deposited and yet sufficiently non-flowable such that it does not slump to an essentially uniform layer coating when deposited on a substrate has proved very difficult.

Chasman et al., in U.S. Pat. No. 4,773,920 disclosed that using a rotogravure coater, it is possible to apply a uniform pattern of ridges and valleys to the binder composition which, when cured, can serve as channels for the removal of lubricant and swarf. However beyond the bare statement of possibility, no details are given that might teach how this might be carried out.

In U.S. Pat. No. 4,644,703 Kaczmarek et al. used a rotogravure roll in a more conventional fashion to deposit an abrasive/binder formulation to deposit a layer that is then smoothed out before a second layer is deposited by a rotogravure process on top of the smoothed-out first layer. There is no teaching of the nature of the final cured surface.

In U.S. Pat. No. 5,014,468 (Ravipati et al.) it was proposed to use an abrasive/binder mixture having non-Newtonian flow properties and to deposit this mixture by a rotogravure technique on to a film. In this process the mixture was deposited from the edges of the rotogravure cells to produce a unique structures with deposits of reducing thickness with distance away from the surface surrounding areas devoid of the mixture. If the cells are sufficiently close together, the surface structures can appear interlinked. This product has proved very useful, particularly in ophthalmic fining operations. The process is very useful but it has a potential problem with increasing build-up of material in the cells of the rotogravure roll such that the deposition pattern can change slightly during a protracted production run. In addition the nature of the process is such that it is limited to formulations containing relatively fine abrasive grits, (usually less than 20 microns).

Another approach has been to deposit the abrasive/binder mixture on a substrate surface and then impose a pattern comprising an array of isolated islands on the mixture by curing the binder while in contact with a mold having the inverse of the desired patterned surface. This approach is described in U.S. Pat. Nos. 5,437,754; 5,378,251; 5,304,223 and 5,152,917. There are several variations on this theme but all have the common feature that each island in the pattern is set by curing the binder in contact with a molding surface. This approach too is not without its problems in that incomplete pull-out from the mold often occurs such that, instead of producing, for example pyramids, volcano shapes complete with crater, frequently result.

The present invention presents a technique for producing uniformly patterned shapes of an abrasive/binder combination that does not require a cure-in-mold operation or the selection of a binder/abrasive combination with specific non-Newtonian flow characteristics.

The present invention therefore provides a flexible and effective route for the commercial scale production of coated abrasives with a uniform array of isolated abrasive composite shapes. Such coated abrasives are well adapted to the treatment of a wide range of substrates to yield fine finishes for protracted periods of operation at a substantially uniform cut rate.

GENERAL DESCRIPTION OF THE INVENTION

The problem encountered in the use of rotogravure techniques to produce patterned coated abrasive materials has always been the retention of a useful shape and pattern after the deposition of the formulation. Most frequently the deposited shape loses its vertical dimensions and tends to run across the surface and join up with adjacent shapes. This problem is referred to in comparative Examples C and D of U.S. Pat. No. 5,152,917 which was discussed above. In U.S. Pat. No. 5,014,468, the solution adopted therein was to use a formulation with a shear thickening rheology which caused the mixture to be deposited from the edges of the rotogravure cells to form the unique pattern described therein.

It has now been found that an abrasive/binder formulation can be deposited on a substrate and a pattern produced on the formulation surface by an embossing process if the rheology of at least the surface layer of the deposited formulation is modified before embossing. This embossed pattern can then be cured to maintain the embossed structure Theoretical studies of the pattern retention of deposits indicate that surface tension is the driving force leading to flow (and hence loss of the pattern), and viscosity is the resisting force. Thus retention of the pattern will be favored by low surface tension and high viscosity. However with radiation-curable binders such as are commonly used with the abrasive/binder formulations with which this invention is primarily concerned, the surface tension does not vary much and is generally in the range of about 30–40 dynes/cm. A properly formulated water-based abrasive/binder mixture also generally has a surface tension in the same range. Thus the viscosity is the most result-affecting parameter which can be adjusted.

The present invention therefore comprises a process for the production of a coated abrasive comprising a pattern of abrasive/binder composites adhered to a backing material said process comprising:

(a) depositing a slurry formulation comprising abrasive grits (and optionally fillers, grinding aids, and other additives), and a curable resin binder on a substrate in a continuous or patterned manner;

(b) treating the deposited formulation to render at least the surface portion of the formulation plastic but non-flowing;

(c) embossing a pattern upon the binder/abrasive formulation; and subsequently (d) curing the binder component of the formulation to retain said pattern.

The key to this process is the treatment to render at least the surface portion of the formulation plastic but non-flowing. By this it is meant that the surface is sufficiently plastic that it can be embossed using an embossing tool but that it will substantially retain the embossed shape for at least 30 seconds after removal of the embossing tool. A shape is considered to have been "substantially retained" if the vertical height of the embossed shape above the substrate does not decrease by more than 10%.

Prior to embossing, the viscosity of the binder/abrasive formulation is modified in such a way as to limit the flow that would tend to occur at the lower viscosities at which the formulation is conventionally deposited. It is however not necessary that the viscosity of the whole of the formulation be adjusted to the higher level. It is often sufficient if the outer exposed portion quickly attain the higher viscosity since this can then act as a skin so as to retain the embossed shape even if the inner portion retains a relatively lower viscosity for a longer period.

Viscosity modification of at least the surface layers can be achieved for example by incorporating in to the formulation a volatile solvent that is rapidly lost when the formulation is deposited on the backing material, perhaps with the assistance of an increased ambient temperature or by a localized blast of hot gas.

Temperature of course can also affect the viscosity. It is therefore important to balance these competing effects to ensure that the result is increasing viscosity. One factor assisting in this direction would be a tendency for increased temperature to cause accelerated curing in the case of thermally curable resin systems. Another option would be to decrease the temperature of the structure such that the viscosity is increased. This could be done for example by passing the substrate with the layer of deposited formulation thereon under a chilled roll and/or under a cold gas flow.

In addition to adjustment by change of temperature or removal of liquid, it is possible to change the viscosity by increasing the solids loading. In general, it is sufficient that the surface layer achieve the higher viscosity so as to hold a shape subsequently embossed thereon. Thus applying a finely divided "functional powder" on to the surface of the structure will act to form a localized "skin" of increased viscosity upon the structure causing it to retain an imposed shape until cure renders the shape permanent.

In the present application the term "functional powder" is used to refer to finely divided, (that is, with an average particle size, $D_{50}$, of less than 250 micrometers), material that modifies the properties of the formulation. This can be as simple as a viscosity modification or an improved property in the cured formulation such as grinding efficiency. The functional powder can also act to serve as a releasing agent or a barrier between the resin formulation and the embossing tool, reducing sticking problems and allowing improved release from the embossing tool.

The powder can be applied in the form of a single layer on top of the abrasive/binder composite or in several layers to form a structured composite having unique grinding properties. This is in fact an advantageous and preferred aspect of the invention.

The powder itself can be an abrasive or a variety of powdered materials, or a combination of the previous, conferring advantageous properties. Abrasive grains usable as the functional powder can consist of any type of abrasive grain and grit size which in some instances may differ from that of the grain used in the adhesive formulation and can lead to unique grinding characteristics. The functional powder can also consist of any of the family of grinding aids, antistatic additives, any class of fillers, and lubricants.

The deposition of the functional powder layer(s) can be done using a variety of conventional deposition methods. These methods include gravity coating, electrostatic coatings, spraying, vibratory coatings, etc.. The deposition of varying powders can occur simultaneously or in an ordered fashion to create a composite structure before embossing.

In one preferred embodiment of the invention the deposition of the abrasive/binder slurry formulation on the backing can be done in two or more layers. Thus for example it is possible to deposit initially a slurry formulation with a first abrasive grain and then deposit on top a second layer with a different abrasive grain. The grain content of the upper layer could then be made higher, or of a superior quality, than the grain in the lower layer. Alternatively, or perhaps additionally, the upper layer could be provided with a grinding aid component whereas the lower layer has none. Such approaches, and others that are similar that can readily be conceived, allow the coated abrasive product to grind more efficiently. This is because, when a structured abrasive comprising isolated abrasive/binder composites is formed in the embossing stage, the portions of the composites which actually are in use before the coated abrasive product is discarded are typically the portions furthest removed from the backing material. It would therefore make sense to avoid putting expensive abrasive grain in the bottom portion of the composite and have the larger abrasive content near the exposed surface of the composite. The same reasoning would lead the instructed reader to concentrate any grinding aid added near the upper surface of the composite structure.

It is also possible to provide that, where the formulation is deposited in a plurality of layers, the upper layer is itself of a more viscous formulation, perhaps as a result of the addition of higher concentrations of abrasive grains or grinding aid. This can provide part or all of the operation in which the surface portion of the slurry formulation is rendered plastic but non-flowing.

After the increase in viscosity has been achieved, the layer is embossed to impose a pattern. This pattern can comprise isolated islands of formulation, or a pattern of ridges separated by valleys. The patterns are generally designed to provide an abrasive product with a plurality of grinding surfaces equidistant from the backing with the area of grinding surface increasing with erosion of the layer. Between the grinding surfaces, channels are often provided to allow circulation of grinding fluids and removal of swarf generated by the grinding.

Embossing can be accomplished by an embossing tool such as a plate forced into contact with the layer of formulation or, often more simply, the tool can comprise a roller with the desired pattern engraved on its surface which when contacted with the slurry formulation imposes the reverse of the pattern engraved on the surface. In addition, the embossing tool can be heated or chilled so as to contribute to the raising of the viscosity to render the formulation surface plastic but non-flowing. The heating however, should not be to such a level that the binder cures while in contact with the tooling. By adjusting the viscosity of the resin formulation or the surface layer, the ultimate goal is that after embossing, the shape imposed by the embossing tool is substantially retained for at least 30 seconds and preferably for a minute. Most preferably the shape is retained until later cure of the binder component can be effected.

It is often preferred that the embossed surface is relatively tacky after the embossing such that a functional powder can be deposited thereon before the cure is completed such that completion of the cure causes the functional powder to become adhered to the outer surface of the embossed shape. Where the powder is an abrasive, this greatly increases the aggressiveness of the initial cut. In addition, if the powder is a grinding aid or anti-loading additive, it s located in the optimum position relative to the abrasive grains in the composites. Alternatively it is possible to apply over the embossed or perhaps over the cured and embossed surface a fine layer of an adhesive and thereafter a further coating of the functional powder of the kinds discussed above. The adhesive can be of the same or different type as is present in the abrasive/binder formulation.

DETAILED DESCRIPTION OF THE INVENTION

Figure 1:
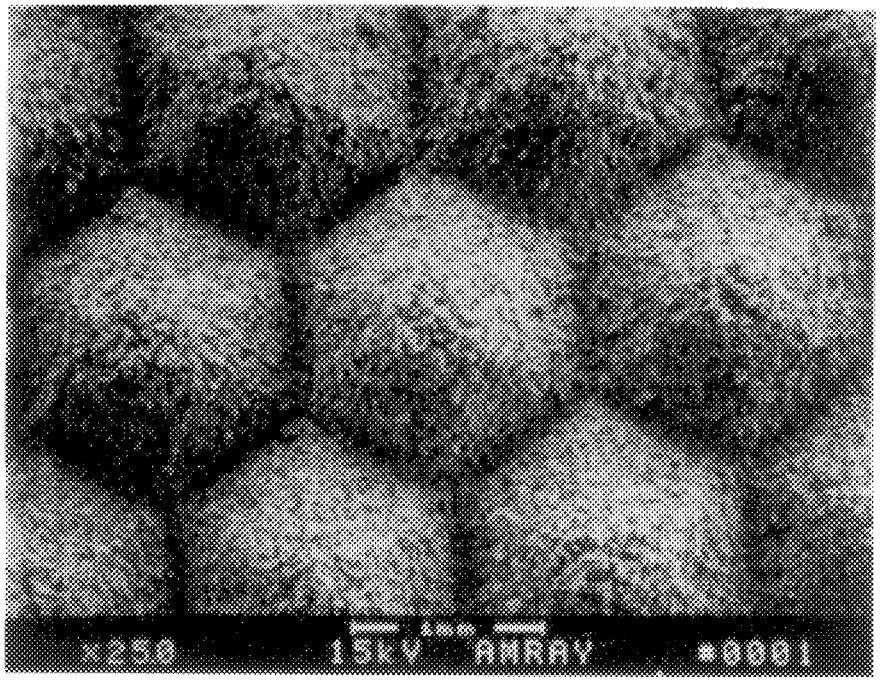
FIGS. 1–5 presented herein are SEM photomicrographs of products made according to the process of the invention with an abrasive slurry coated with additional abrasive grains.

The coating method used to place the slurry on to a conventional substrate can comprise of a variety of conventional coating methods including knife on roll, knife on web, two or three roll coating, reverse roll coating, gravure coating, slot-die coating, spraying, curtain coating, screen printing, etc.. It is important that the slurry coating may be in the form of a continuous coating or in a patterned fashion as would be deposited by a gravure cell. In addition, coatings may be applied in several layers or in alternating layers with the functional powder to achieve a composite with unique grinding characteristics.

The embossing tool can have any desired pattern and this is determined in large part by the intended purpose of the coated abrasive product. It is for example possible to provide that the tool is in the form of a roller with surface grooves, (for example tri-helical grooves), cut in the roll surface. This is often a very advantageous configuration and can be adapted to produce a pattern of diagonal stripes that is at once very distinctive and also very effective for grinding. Alternatively the tool may be engraved with a plurality of cells which are reproduced as isolated islands in the pattern imposed on the abrasive/binder layer. Many useful surface designs can be devised, including isolated islands of formulation or groups of patterns of islands. The tooling itself may consist of any type of conventional embossing moldings such as metal-plated toolings, plastic toolings, ceramic-based toolings, etc..

The abrasive component of the formulation can be any of the available materials known in the art such as alpha alumina, (fused or sintered ceramic), silicon carbide, fused alumina/zirconia, cubic boron nitride, diamond and the like as well as the combination of thereof. Abrasive particles useful in the invention typically and preferably have an average particle size from 1 to 150 micron, and more preferably from 1 to 80 micron. In general however the amount of abrasive present provides from about 10 to about 90%, and preferably from about 30 to about 80%, of the weight of the formulation.

The other major component of the formulation is the binder. This is a curable resin formulation selected from radiation curable resins, such as those curable using electron beam, UV radiation or visible light, such as acrylated oligomers of acrylated epoxy resins, acrylated urethanes and polyester acrylates and acrylated monomers including monoacrylated, multiacrylated monomers, and thermally curable resins such as phenolic resins, urea/formaldehyde resins and epoxy resins, as well as mixtures of such resins. Indeed it is often convenient to have a radiation curable component present in the formulation that can be cured relatively quickly after the formulation has been deposited so as to add to the stability of the deposited shape. In the context of this application it is understood that the term "radiation curable" embraces the use of visible light, ultraviolet (UV) light and electron beam radiation as the agent bringing about the cure. In some cases the thermal cure functions and the radiation cure functions can be provided by different functionalities in the same molecule. This is often a desirable expedient.

The resin binder formulation can also comprise a non-reactive thermoplastic resin which can enhance the self-sharpening characteristics of the deposited abrasive composites by enhancing the erodability. Examples of such thermoplastic resin include polypropylene glycol, polyethylene glycol, and polyoxypropylene-polyoxyethene block copolymer, etc.

Fillers can be incorporated into the abrasive slurry formulation to modify the rheology of formulation and the hardness and toughness of the cured binders. Examples of useful fillers include: metal carbonates such as calcium carbonate, sodium carbonate; silicas such as quartz, glass beads, glass bubbles; silicates such as talc, clays, calcium metasilicate; metal sulfate such as barium sulfate, calcium sulfate, aluminum sulfate; metal oxides such as calcium oxide, aluminum oxide; and aluminum trihydrate.

The abrasive slurry formulation may comprise a grinding aid to increase the grinding efficiency and cut rate. Useful grinding aid can be inorganic based, such as halide salts, for example sodium cryolite, potassium tetrafluoroborate, etc.; or organic based, such as chlorinated waxes, for example polyvinyl chloride. The preferred grinding aids in this formulation are cryolite and potassium tetrafluoroborate with particle size ranging from 1 to 80 micron, and most preferably from 5 to 30 micron. The weight percent of grinding aid ranges from 0 to 50%, and most preferably from 10–30%.

The abrasive/binder slurry formulations used in the practice of this invention may further comprise additives including: coupling agents, such as silane coupling agents, for example A-174 and A-1100 available from Osi Specialties, Inc., organotitanates and zircoaluminates; anti-static agents, such as graphite, carbon black, and the like; suspending agents, such as fumed silica, for example Cab-O-Sil M5, Aerosil 200; anti-loading agents, such as zinc stearate; lubricants such as wax; wetting agents; dyes; fillers; viscosity modifiers; dispersants; and defoamers.

Depending on the application, the functional powder deposited on the slurry surface can impart unique grinding characteristics to the abrasive products. Examples of functional powders include: 1) abrasive grains—all types and grit sizes; 2) fillers—calcium carbonate, clay, silica, wollastonite, aluminum trihydrate, etc.; 3) grinding aids—$KBF_4$, cryolite, halide salt, halogenated hydrocarbons, etc.; 4) anti-loading agents—zinc stearate, calcium stearate, etc., 5) anti-static agents—carbon black, graphite, etc., 6) lubricants—waxes, PTFE powder, polyethylene glycol, polypropylene glycol, polysiloxanes etc..

The backing material upon which the formulation is deposited can be a fabric, (woven, non-woven or fleeced), paper, plastic film or metal foil. Generally, the products made according to the present invention find their greatest utility in producing fine grinding materials and hence a very smooth surface is preferred. Thus finely calendered paper, plastic film or a fabric with a smooth surface coating is usually the preferred substrate for deposition of the composite formulations according to the invention.

The invention will be further described with respect to certain specific embodiments which are understood to be for the purposes of illustration only and imply no necessary limitation on the scope of the invention.

Abbreviations

To simplify data presentation, the following abbreviations will be used:

Polymer Components

Ebecryl 3605, 3700—acrylated epoxy oligomers available from UCB Radcure Chemical Corp.

TMPTA—trimethylol propane triacrylate available from Sartomer Company, Inc..

ICTA—isocyanurate triacrylate available from Sartomer Co., Inc..

TRPGDA—tripropylene glycol diacrylate available from Sartomer Co., Inc..

Binder Components

Darocure 1173—a photoinitiator available from Ciba-Geigy Company

Irgacure 651—a photoinitiator available from Ciba-Geigy Company

2-Methylimidazole—a catalyst from the BASF Corp.

Pluronic 25R2—polyoxypropylene-polyoxyethylene block copolymer available from the BASF Corp.

$KBF_4$—grinding aid with a median particle size of approximately 20 $\mu$m available from Solvay.

Cab-O-Sil M5—fumed silica from Cabot Corporation

Grain

FRPL—fused $Al_2O_3$ from Treibacher (P320 or P1000: grade indicated by "P-number").

Calcined $Al_2O_3$ (40 $\mu$m) from Microabrasives Corporation.

Backings 3 mil Mylar film for ophthalmic applications 5 mil Mylar film for metalworking applications Surlyn-coated J-weight polyester cloth

* Surlyn is an ionomer resin SURLYN 1652-1 from Du Pont.

Abrasive Slurry Formulations

TABLE I

| Component | I | II | III | IV |
|---|---|---|---|---|
| Ebecryl 3605 | 19.3% | | | |
| Ebecryl 3700 | | 6.3% | | |
| NVP | 8.3% | | | |
| ICTA | | 7.9% | 14.7% | 14% |
| TMPTA | | 8.1% | 14.7% | 14% |
| TRPGDA | | 5.3% | | |
| Irgacure 651 | | 0.8% | | |
| Darocure 1173 | 1.1% | | 0.6% | 0.6% |
| 2 MI | 0.2% | | | |
| Cab-O-Sil | | 0.8% | | |
| Silane | 1.1% | 0.8% | | |
| Pluronic 25R2 | | | | 1.4% |
| $KBF_4$ | 23.3% | 23.3% | 23.3% | 23.3% |
| Grain | 46.7% | 46.7% | 46.7% | 46.7% |

Formulation Preparation Procedure

The monomers and/or oligomer components were mixed together for 5 minutes using a high shear mixer at 1000 rpm. This binder formulation was then mixed with any initiators, wetting agents, defoaming agents, dispersants etc. and mixing was continued for 5 minutes further at the same rate of stirring. Then the following components were added, slowly and in the indicated order, with five minutes stirring at 1500 rpm between additions: suspension agents, grinding aids, fillers and abrasive grain. After addition of the abrasive grain the speed of stirring was increased to 2,000 rpm and continued for 15 minutes. During this time the temperature was carefully monitored and the stirring rate was reduced to 1,000 rpm if the temperature reached 40.6° C.

Deposition of the Formulation

The resin formulation was coated on to a variety of conventional substrates listed previously. In the cited cases the abrasive slurry was applied using a knife coating with the gap set at desired values. Coating was done at room temperatures.

Application of Functional Powders and Embossing

Before embossing, the surface layer of the slurry was modified with abrasive grits with the same particle size or finer than that used in the formulation. Enough was deposited to form a single layer adhered by the uncured binder component. Excess powder was removed from the layer by vibration. Application of the powder was by a conventional, vibratory screening method.

Once the substrate had been coated with the uncured slurry formulation and the functional powder applied, an embossing tool with the desired pattern was used to impart the desired shape to the abrasive resin and grain formulation. This embossing setup included a steel backing roll which imparted the necessary support during the application of pressure by the steel embossing roll. A wire brush setup was used to remove any dry residue or loose grains remaining in the cells after the tool had imparted its impression on to the viscosity modified formulation.

Cure

After the pattern was embossed into the viscosity-modified layer, the substrate was removed from the embossing tooling and passed to a curing station. Where the cure is thermal, appropriate means are provided. Where the cure is activated by photoinitiators, a radiation source can be provided. If UV cure is employed, two 300 watt sources are used: a D bulb and an H bulb with the dosage controlled by the rate at which the patterned substrate passed under the sources. In the case of the matrix of experiments listed in Table 2, the cure was by UV light. In the case of the Formulation I, however, UV cure was immediately followed by a thermal cure. This curing process was adequate to ensure final dimensional stability.

Figure 2:
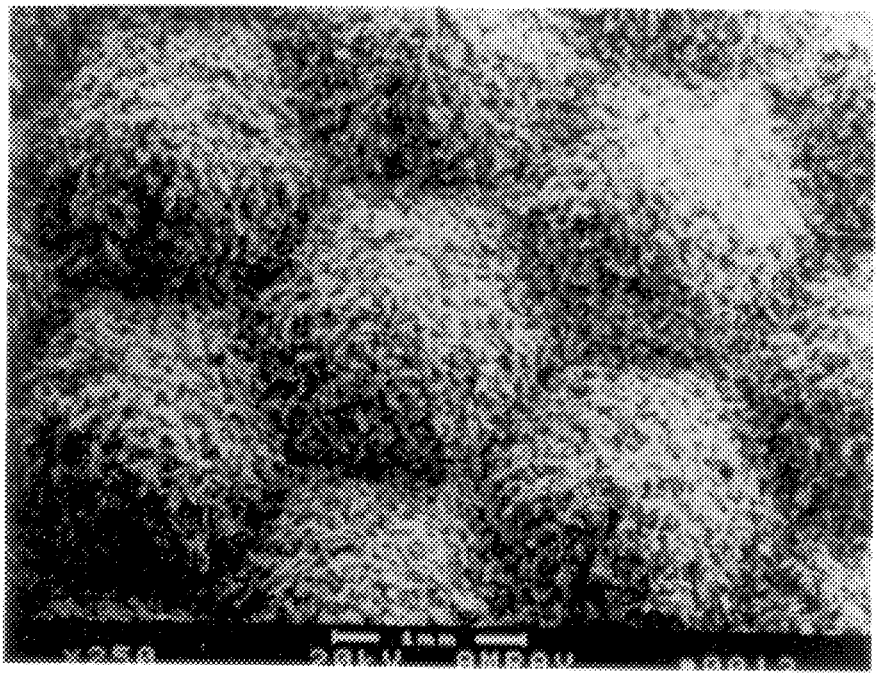

In the first example, the layer was embossed by a roll having cells engraved therein in a 17 Hexagonal pattern. This produced the pattern of hexagonal shaped islands shown in FIGS. 1 and 2. In each, an abrasive grit was dusted on the surface to serve as the functional powder. In FIG. 1 the abrasive dusted on the surface was P1000 and in FIG. 2 it was P320. In each case the abrasive/binder formulation was Formulation I.

Figure 3:
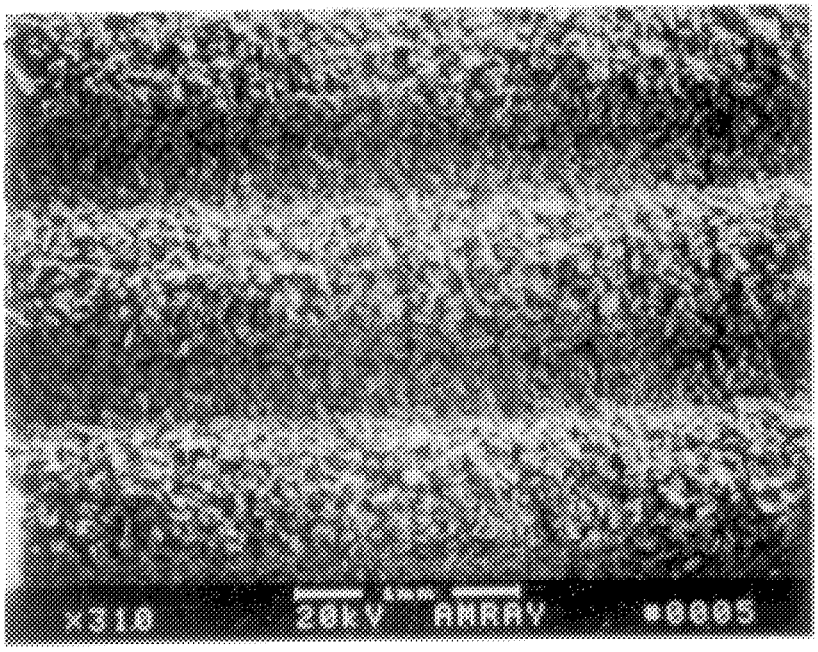
Figure 4:
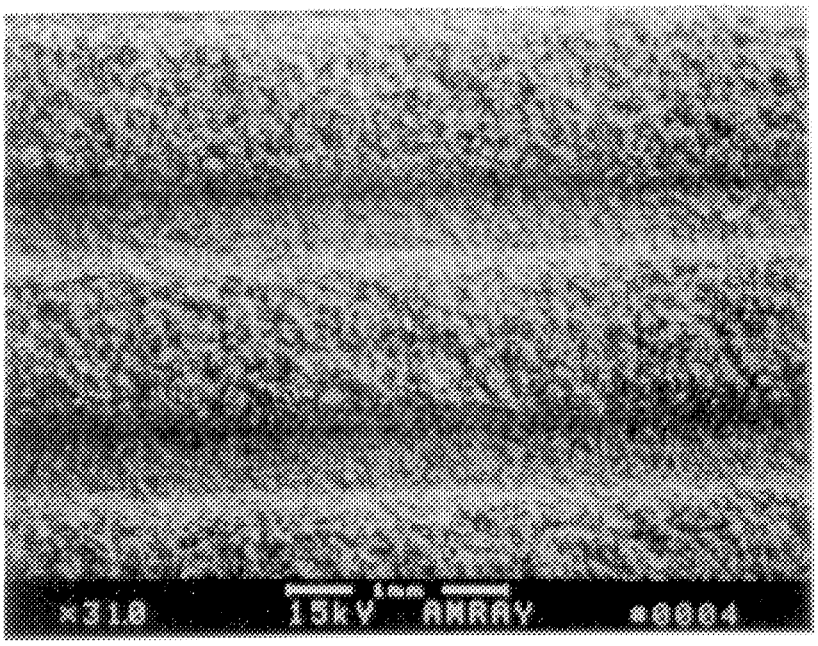

In the second example the embossing roll was engraved with a 25 Tri-helical roll surface pattern of grooves. FIGS. 3 and 4 show formulations III and IV as is used in the first experiment coated with P320 and P1000 abrasive grits respectively. The same coating technique was used.

Figure 5:
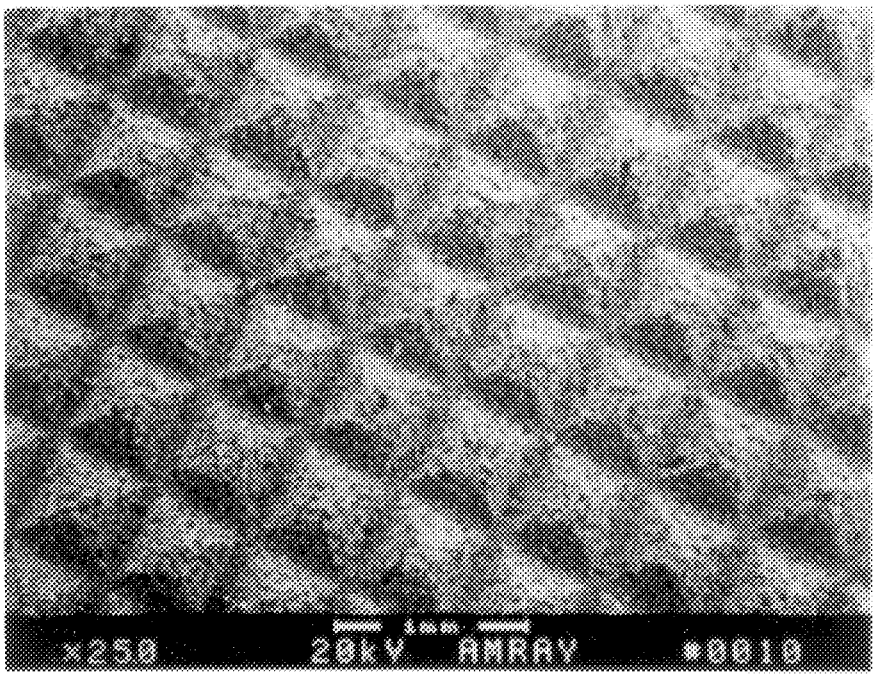

In a third example the pattern engraved on the embossing roll was 45 Pyramid with formulation I giving a pattern of isolated square-based pyramids. The surface was modified by application of P1000 grit over the same formulation used in the first and second experiments. The result is shown in FIG. 5.

In all three experiments the structures on the embossed surface remained essentially unchanged from the time of the embossing to the time the binder component was fully cured.

Additional examples, similar in shape but varying in formulation and abrasive content were also carried out as listed in Table 2. In all cases, the manufacturing process is identical to the first three examples; however, variations were made in the resin composition and functional powders.

The 17 Hexagonal embossing roll pattern comprised cells 559 microns in depth with equal sides of 1000 microns at the top and 100 microns at the bottom.

The 25 Tri-helical pattern comprised of a continuous channel cut at 45 degrees to the roll axis that has a depth of 508 microns and top opening width of 750 microns.

The 40 Tri-helical pattern comprised of a continuous channel cut at 45 degrees to the roll axis that has a depth of 335 microns and a top opening width of 425 microns.

The 45 Pyramidal pattern comprised a square-based, inverted pyramid shaped cells with a depth of 221 microns and a side dimension of 425 microns.

Grinding Tests

Several of the listed samples were subjected to two primary forms of grinding testing with the data listed in Tables 3–5. The first form of testing consisted of Schieffer testing up to 600 revolutions with an 8 lbs. of constant load on a hollow, 304 stainless steel workpiece with a 1.1 inch O.D. which gives a effective grinding pressure of 23.2 psi.. The patterned abrasive was cut into disks of 4.5" diameter and mounted to a steel backing plate. Both the backing plate and the workpiece rotate in a clockwise fashion with the backing plate rotating at 195 RPM and the workpiece rotating at 200 RPM. Workpiece weight loss was noted every 50 revolutions and totaled at the end of 600 revolutions.

The second method of testing consisted of a microabrasive ring testing. In this test, nodular cast iron rings (1.75 inch O.D., 1 inch I.D. and 1 inch width), were pre-roughened using a 60 $\mu$m. conventional film product and then ground at 60 psi. with the patterned abrasive. The abrasive was first sectioned into 1" width strips and was held against the workpiece by rubber shoes. The workpiece was rotated at 100 RPM and oscillated in the perpendicular direction at a rate of 125 oscillations/minute. All grinding was done in a lubricated bath of OH200 straight oil. Weight loss was recorded every 10 revolutions and totaled at the end of the test.

TABLE 2

| Example | Embossed Pattern | Lines/Inch | Resin Formulation | Slurry Thickness (mils) | Grain in Slurry | Functional Powder |
|---|---|---|---|---|---|---|
| 1 | Hexagonal | 17 | I | 5 | P320 | P1000 |
| 2 | Hexagonal | 17 | I | 8 | P320 | P1000 |
| 3 | Hexagonal | 17 | I | 10 | P320 | P1000 |
| 4 | Hexagonal | 17 | I | 10 | P320 | P320 |
| 5 | Tri-Helical | 25 | II | 7 | P320 | P320 |
| 6 | Tri-Helical | 25 | I | 7 | P320 | P320 |
| 7 | Tri-Helical | 25 | I | 7 | P320 | P1000 |
| 8 | Tri-Helical | 25 | III | 7 | P320 | P320 |
| 9 | Tri-Helical | 25 | III | 7 | P320 | P320 + $KBF_4$ |
| 10 | Tri-Helical | 25 | III | 7 | 40 $\mu$m | 40 $\mu$m |
| 11 | Tri-Helical | 25 | IV | 7 | 40 $\mu$m | 40 $\mu$m |
| 12 | Tri-Helical | 40 | III | 5 | P320 | P320 + $KBF_4$ |
| 13 | Tri-Helical | 40 | III | 5 | 40 $\mu$m | 40 $\mu$m |
| 14 | Tri-Helical | 40 | IV | 5 | 40 $\mu$m | 40 $\mu$m |
| 15 | Pyramidal | 45 | I | 5 | P320 | P1200 |
| 16 | Pyramidal | 45 | I | 7 | P320 | P1200 |
| 17 | Pyramidal | 45 | I | 7 | P320 | P320 |
| 18 | Pyramidal | 45 | I | 10 | P320 | P1000 |

TABLE 3

Schieffer Testing of Patterned Abrasives with FRPL P320 grain in Slurry Formulation. (500 Revolutions)

| Example | Pattern | Grain in Slurry | Functional Powder | Total Cut (% of Control) |
|---|---|---|---|---|
| 18 | 45 Pyramid (Control) | P320 | P1000 | 100% |
| 3 | 17 Hexagonal | P320 | P1000 | 104% |
| 4 | 17 Hexagonal | P320 | P320 | 113% |
| 8 | 25 Tri-Helical | P320 | P320 | 115% |
| 9 | 25 Tri-Helical | P320 | P320 + $KBF_4$ | 143% |

TABLE 4

Schieffer Testing of Patterned Abrasives with Calcined $Al_2O_3$ 40 μm Grains in Slurry Formulation. (600 Revolutions)

| Example | Pattern | Grain in Slurry | Functional Powder | Total Cut (% of Control) |
|---|---|---|---|---|
| C-1 (Control) | None | N/A | N/A | 100% |
| 10 | 25 Tri-Helical | 40 μm | 40 μm | 131% |
| 13 | 40 Tri-Helica1 | 40 μm | 40 μm | 110% |

TABLE 5

Ring Testing for Microfinishing Applications (50 Revolutions at 60 psi.)

| Example | Pattern | Grain in Slurry | Functional Powder | Total Cut (% of Control) |
|---|---|---|---|---|
| C-1 (Control) | None | N/A | N/A | 100% |
| 10 | 25 Tri-Helical | 40 μm | 40 μm | 109% |

In Table 3, the effect of the type of functional powder and pattern is clearly demonstrated. With the 45 Pyramid (P320 in the formulation and P1000 as the functional powder) as the control, using a larger 17 hexagonal shape pattern the same resin formulation and functional powder resulted in a slight increase in total cut. In all cases where the P1000 was substituted with a coarser P320 grade, the cut was further increased. In addition, the tri-helical pattern outperformed the hexagonal pattern. In the final case where the functional powder consisted of a blend of $KBF_4$ and P320, the cut was dramatically increased. From this set of data it can be clearly seen that the pattern type coupled with the type of functional powder clearly alters the grinding characteristics.

In Table 4, the patterned abrasives were compared to comparative example C-1, a 40 μm grit conventional microfinishing abrasive under the trade name of Q151 from Norton Co.. It can be observed in both patterned abrasives, the total cut was increased significantly over the conventional product with the 25 Tri-helical outperforming the finer 40 Tri-helical pattern.

In Table 5, the 40 μm patterned abrasives were compared in a microfinishing application. Once again, compared to the comparative example C-1, a conventional abrasive product under the trade name of Q151 from Norton Co., the patterned abrasive demonstrates an improvement in the total cut. Overall, the above patterns performed well in the abrasive testing applications, generating effective abrading from the start.

What is claimed is:

1. A process for the production of a coated abrasive comprising a pattern of abrasive/binder composites adhered to a backing material, said process comprising:

a) depositing a slurry formulation comprising an abrasive and a curable resin binder on a substrate in a continuous or patterned manner, (b) treating the deposited formulation to render at least the surface portion of the formulation plastic but non-flowing;

(c) thereafter embossing a pattern upon the binder/abrasive formulation; and subsequently (d) curing the binder component of the formulation to retain said pattern.

2. A process according to claim 1 in which the deposited formulation is rendered plastic but non-flowing by increasing the viscosity of at least the surface portion of the formulation through the application of a functional powder.

3. A process according to claim 2 in which the functional powder is selected from the group consisting of abrasives, fillers, grinding aids, anti-static powders, stearated powders and mixtures thereof.

4. A process according to claim 1 in which the slurry formulation is deposited in at least two layers of different compositions.

5. A process according to claim 2 in which a functional powder is also deposited between layers of the slurry composition to form a multi-layered slurry formulation structure.

6. A process according to claim 1 in which abrasive/binder formulation comprises at least one volatile component and the concentration of the abrasive component in the surface layer is increased by removal of at least some of the volatile component.

7. A process according to claim 1 in which the deposited formulation is rendered plastic but non-flowing by reducing the temperature thereof before application of the embossing tool.

8. A process according to claim 1 in which the binder comprises a radiation or thermally curable resin, or a combination thereof.

9. A process according to claim 1 in which the binder resin comprises a non-reactive thermoplastic component.

10. A process according to claim 1 in which the abrasive comprises from about 10 to 90%, of the weight of the formulation.

11. A process according to claim 1 in which the abrasive grit is selected from the group consisting of cerium, alumina, fused alumina/zirconia, silicon carbide, cubic boron nitride, and diamond.

12. A process according to claim 1 in which the formulation also comprises one or more additives selected from the group consisting of, grinding aids, inert fillers, anti-static agents, lubricants, anti-loading agents and mixtures thereof.

13. A process according to claim 12 in which the formulation comprises a grinding aid selected from the group consisting of cryolite, potassium tetrafluoroborate and mixtures thereof.

14. A coated abrasive prepared by a process according to claim 1.

15. A coated abrasive prepared by a process according to claim 2.

16. A coated abrasive prepared by a process according to claim 3.

17. A coated abrasive prepared by a process according to claim 5.

* * * * *

UNITED STATES PATENT AND TRADEMARK OFFICE

CERTIFICATE OF CORRECTION

PATENT NO : 5,863,306

DATED : Jan. 26, 1999

INVENTOR(S): Paul Wei, Gwo Shin Swei, Wenliang Patrick Yang and Kevin Bruce Allen It is certified that error appears in the above-identified patent and that said Letters Patent is hereby corrected as shown below:

Column 12, line 44 change "cerium" to --ceria--.

Signed and Sealed this

Thirteenth Day of July, 1999

*Attest:*

*Attesting Officer*

Q. TODD DICKINSON

*Acting Commissioner of Patents and Trademarks*